US009579864B2

(12) United States Patent
Lyle et al.

(10) Patent No.: US 9,579,864 B2
(45) Date of Patent: Feb. 28, 2017

(54) SOLAR-POWERED WASTE COMPACTOR AND METHOD OF OPERATION THEREOF

(71) Applicant: Marathon Equipment Company, Vernon, AL (US)

(72) Inventors: Bradley L. Lyle, Steens, MS (US); James K. Robbins, Fayette, AL (US)

(73) Assignee: Marathon Equipment Company, Vernon, AL (US)

( * ) Notice: Subject to any disclaimer, the term of this patent is extended or adjusted under 35 U.S.C. 154(b) by 881 days.

(21) Appl. No.: 13/917,716

(22) Filed: Jun. 14, 2013

(65) Prior Publication Data

US 2013/0276646 A1 Oct. 24, 2013

Related U.S. Application Data

(62) Division of application No. 12/892,296, filed on Sep. 28, 2010, now Pat. No. 8,479,648.

(51) Int. Cl.

| | |
|---|---|
| ***B30B 13/00*** | (2006.01) |
| ***B30B 15/16*** | (2006.01) |
| ***B30B 9/30*** | (2006.01) |

(52) U.S. Cl.

CPC ..... *B30B 15/166* (2013.01); *B30B 9/305* (2013.01); *B30B 9/3007* (2013.01); *B30B 9/3057* (2013.01); *B30B 13/00* (2013.01); *B30B 15/161* (2013.01)

(58) Field of Classification Search

CPC ..... B30B 9/305; B30B 9/3057; B30B 9/3007; B30B 9/3082; B30B 9/321; B30B 9/3028; B30B 9/3042; B30B 15/166; B30B 15/161; B30B 15/08; B30B 13/00; F03G 6/001; Y02P 70/141; H02J 7/355; Y02E 10/46

USPC ..... 100/35, 43, 45, 48, 50, 99, 346, 347,100/229 A, 269.01, 270, 271, 269.05, 269.14

See application file for complete search history.

(56) References Cited

U.S. PATENT DOCUMENTS

| | | | |
|---|---|---|---|
| 2,200,495 | A | 5/1940 | Fife |
| 3,955,492 | A | 5/1976 | Topolay |
| 4,080,891 | A | 3/1978 | Manko |
| 5,004,535 | A | 4/1991 | Bosko et al. |

(Continued)

FOREIGN PATENT DOCUMENTS

| | | | |
|---|---|---|---|
| DE | 3614967 | A1 | 11/1987 |
| EP | 2319685 | A2 | 5/2011 |

(Continued)

*Primary Examiner* — Jimmy T Nguyen

(74) *Attorney, Agent, or Firm* — Berenato & White, LLC

(57) ABSTRACT

A solar-powered waste compactor comprises a waste container for housing waste, a compactor ram actuated by a hydraulic cylinder and piston assembly for compacting the waste in the waste container, and a hydraulic power unit operably associated with the hydraulic cylinder and piston assembly for powering the compactor ram. The hydraulic power unit comprises a motor/pump assembly including a pump unit, a single-phase electric motor driving the pump unit and a flow control valve operating the motor/pump assembly at first or second flow rate depending on an operating pressure. The hydraulic power unit further comprises a battery unit, a solar panel to charge the battery unit, a DC-to-AC inverter, a single-phase AC power inlet connectable to a source of a single-phase electrical power grid, and a reversing contactor providing the electric current only from the inverter or the power inlet at any given time.

13 Claims, 3 Drawing Sheets

(56) References Cited

U.S. PATENT DOCUMENTS

| | | | | |
|---|---|---|---|---|
| 5,415,264 | A * | 5/1995 | Menoud | G07F 11/045 194/217 |
| 6,863,827 | B2 | 3/2005 | Saraceno | |
| 7,000,532 | B2 | 2/2006 | Imperato | |
| 7,007,598 | B1 | 3/2006 | Patras | |
| 7,124,680 | B2 | 10/2006 | Poss et al. | |
| D564,545 | S | 3/2008 | Poss et al. | |
| 7,481,159 | B2 | 1/2009 | Poss et al. | |
| 2007/0101875 | A1 * | 5/2007 | Poss | B30B 9/3007 100/229 A |
| 2007/0209529 | A1 | 9/2007 | Poss et al. | |
| 2008/0067227 | A1 | 3/2008 | Poss et al. | |
| 2008/0257993 | A1 | 10/2008 | Cole et al. | |
| 2009/0013882 | A1 | 1/2009 | Cunningham et al. | |

FOREIGN PATENT DOCUMENTS

| | | |
|---|---|---|
| ES | 2214944 | 9/2004 |
| WO | 2004/110659 A2 | 12/2004 |

* cited by examiner

SOLAR-POWERED WASTE COMPACTOR AND METHOD OF OPERATION THEREOF

CROSS-REFERENCE TO RELATED APPLICATIONS AND CLAIM TO PRIORITY

This application is a divisional of application Ser. No. 12/892,296, filed Sep. 28, 2010, now U.S. Pat. No. 8,479,648, the disclosure of which is incorporated herein by reference and to which priority is claimed under 35 U.S.C. §120.

BACKGROUND OF THE INVENTION

1. Field of the Invention

The present inventions relates to waste compactors in general, and, more particularly, to a solar powered waste compactor and a method of operating the solar powered waste compactor.

2. Description of the Prior Art

There has been a continuing trend for people to visit parks, beaches, campsites, and like remote locations. Removal and disposal of waste from such locations is a continuing problem. Some locations require individuals to remove whatever waste they bring to a location in an effort to assist in keeping the location clean. While most people comply with these requirements, not all do. Waste compactors are used to minimize the volume of waste. Positioning industrial or large compactors at remote locations has not been feasible for various reasons including lack of suitable power.

Commercial, residential, and industrial use trash and waste compactors are known. These compactors typically include a container in which the trash or waste is compacted by a compacting ram driven by a power source.

Relatively small solar-powered trash compactors for home use are also known. However, the power units of these small compactors are not capable of effectively powering an industrial-sized waste compactor operated according to typical industrial compactor operation parameters and output requirements, such as operating pressure, cycle time, and output power. More specifically, industrial sized compactors typically require substantially more power than home or like small compactors. This is due to the fact that industrial sized compactors compact more waste, have larger compaction rams and typically operate more frequently than small compactors.

Accordingly, there is a need for an industrial waste compactor that is energy efficient and can be driven by solar power without compromising industrial compactor operation parameters and output requirements, such as operating pressure, cycle time, and output power.

Electric motors which are used to power industrial waste compactors typically require three phase power, because three phase power makes it possible to produce a rotating magnetic field. Additionally, a delay between phases of current has the effect of transferring constant power over each cycle of the current. However, other applications for three phase power are relatively few in number and there are various parts of the country in which three phase power is not available. For example, three phase power is typically not provided in homes. Three phase power may be difficult to find in rural areas or may be a relatively long distance from where the compactor is to be located.

Accordingly, there is a need for an industrial waste compactor that operates on either 120 volt single-phase AC grid power or 12 volt battery power in locations where electric grid power is not readily available, and yet still meet industrial waste compactor operating and throughput requirements.

SUMMARY OF THE INVENTION

The present invention provides an improved solar-powered waste compactor for compacting waste. The waste compactor of the present invention comprises a waste container for housing the waste, a compactor ram actuated by a hydraulic cylinder and piston assembly for compacting the waste in the waste container, and a hydraulic power unit operably associated with the hydraulic cylinder and piston assembly for powering the compactor ram. The hydraulic power unit comprises a motor/pump assembly including a pump unit, a single-phase electric motor driving the pump unit for selectively providing hydraulic fluid to the hydraulic cylinder and piston assembly, and a flow control valve operating the motor/pump assembly at a first flow rate of the hydraulic fluid when the operating pressure of the pump unit is less than a predetermined threshold value and at a second flow rate of the hydraulic fluid when the operating pressure of the pump unit is greater than the predetermined threshold value. The hydraulic power unit further comprises a battery unit for storing electrical energy and for providing the electrical energy to the single-phase electric motor, a solar panel for converting solar energy to electrical energy to charge the battery unit, a DC-to-AC inverter for converting direct current from the battery unit into a single-phase alternating current, a single-phase AC power inlet connectable to a source of a single-phase electrical power grid, and a reversing contactor including a first contactor provided between the DC-to-AC inverter and the single-phase electric motor and a second contactor provided between the single-phase AC power inlet and the single-phase electric motor. The reversing contactor prevents the first and second contactors from closing the connections thereof at the same time so as to provide the electric current only from the DC-to-AC inverter or the single-phase AC power inlet at any given time and to prevent backflow of electrical current to either the DC-to-AC inverter or to the electrical power grid.

The hydraulic power unit of the present invention operates on either 12 volt battery power or 120 volt single-phase AC grid power, and is programmed for maximum utilization of solar energy.

BRIEF DESCRIPTION OF THE DRAWINGS

Other objects and advantages of the invention will become apparent from a study of the following specification when viewed in light of the accompanying drawings, wherein.

DETAILED DESCRIPTION OF THE PREFERRED EMBODIMENT(S)

Figure 1:
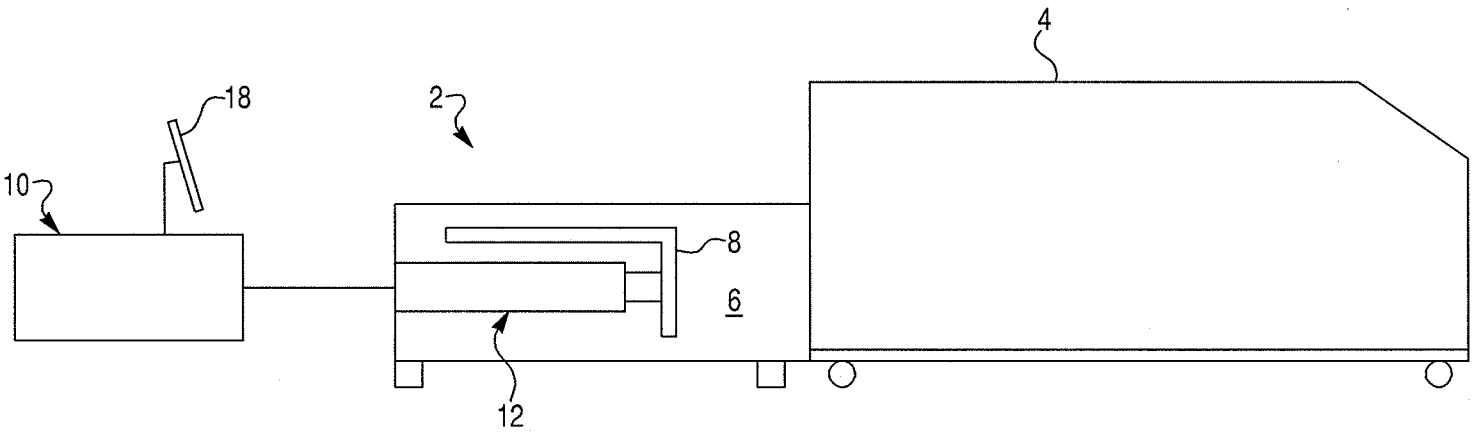
FIG. 1 is a schematic diagram illustrating a waste compactor and a hydraulic power unit according to a preferred exemplary embodiment of the present invention.

The preferred embodiment of the present invention will now be described with the reference to accompanying drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

For purposes of the following description, certain terminology is used in the following description for convenience only and is not limiting. The words "top", "bottom", "right", "left", "lower", "upper", "inner" and "outer" designate directions in the drawings to which reference is made. The words "uppermost" and "lowermost" refer to position in a vertical direction relative to a geometric center of the apparatus of the present invention and designated parts thereof. The terminology includes the words above specifically mentioned, derivatives thereof and words of similar import. Additionally, the word "a" as used in the claims means "at least one".

FIG. 1 illustrates a solar-powered waste compactor 2 according to the present invention, comprising a waste container 4 for housing a waste, a charge box 6, and a compactor ram 8, which is disposed in the charge box 6 and is selectively reciprocated by a hydraulic power unit 10 to compact the waste by transferring it from the charge box 6 to the waste container 4. The compactor ram 8 is actuated by a hydraulic cylinder and piston assembly 12, which is operably associated with the hydraulic power unit 10 in order to allow reciprocation of the compactor ram 8 within the charge box 6. In other words, the hydraulic cylinder and piston assembly 12 is operably associated with the compactor ram 8.

Figure 2:
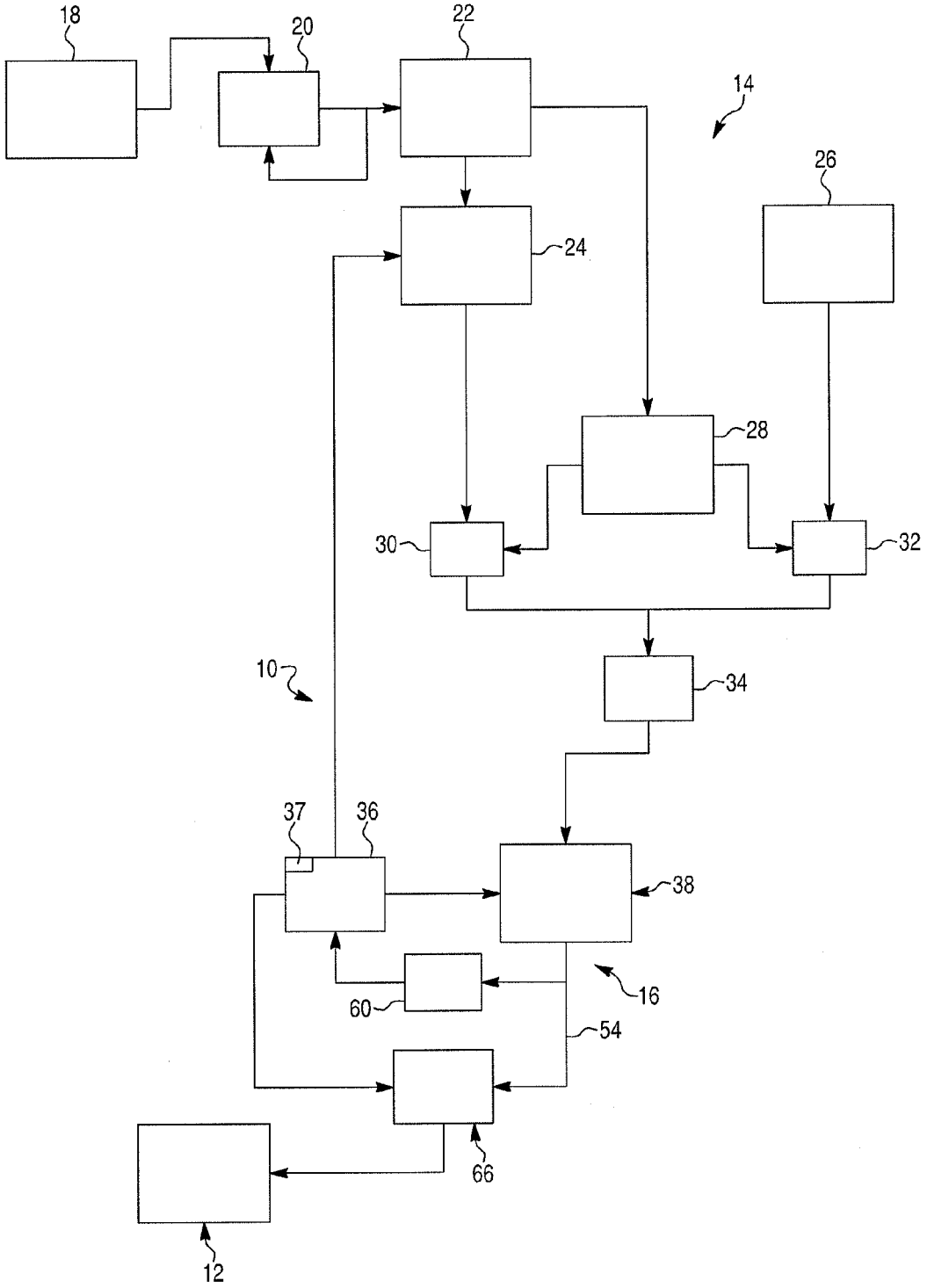
FIG. 2 is a schematic diagram illustrating the hydraulic power unit of FIG. 1.

As best shown in FIG. 2, the hydraulic power unit 10 further includes an electrical circuit 14 and a hydraulic circuit 16. As further illustrated in FIG. 2, the electrical circuit 14 includes a solar panel 18 for converting solar energy into electrical energy, and a solar panel controller 20 that regulates electrical current generated from the solar energy by the solar panel 18. The solar panel 18 may be a 140 Watt solar panel or include two 100 Watt panels for a total of 200 Watts. The electrical circuit 14 further includes battery unit 22 provided to store the electrical current harnessed by the solar panel 18 and to power the components of the hydraulic power unit 10. The battery unit 22 preferably is one or more 12V batteries connected in parallel to obtain, store and supply 12V DC current. In the exemplary embodiment of the present invention, the battery unit 22 includes four 12V storage batteries, which are employed for compactors that have a relatively large hydraulic fluid flow. The solar panel controller 20 transmits and regulates the electrical energy from the solar panel 18 to the battery unit 22 to charge the battery unit 22.

The battery unit 22 is connected to a DC-to-AC inverter 24 that converts the 12 volt direct current (DC) from the battery unit 22 into single-phase 120 volt alternating current (AC). Consequently, the waste compactor 2 operates on either 12 volt DC from the battery unit 22 or 120 volt single-phase AC from a source of a single-phase electrical power grid (i.e., a single-phase AC electrical power source) through a 120V single-phase AC electrical power input 26 of the hydraulic power unit 10 of the waste compactor 2 (shown in FIG. 2). Preferably, the 120V single-phase AC electrical power input 26 of the waste compactor 2 is in the form of a standard 120V single-phase AC electrical power plug, while the source of the single-phase electrical grid power is in the form of a standard 120V single-phase AC electrical power socket or outlet that can be connected to the standard 120V single-phase AC electrical power plug 26 of the hydraulic power unit 10 of the waste compactor 2.

The electrical circuit 14 further includes a reversing contactor comprised first and second contactors 30 and 32, respectively, with a mechanical interlock therebetween, which prevents the two contactors 30 and 32 from closing their connections at the same time. Thus, only one of the contactors 30 and 32 can be closed at any given time.

As best shown in FIG. 2, the first contactor 30 selectively connects the DC-to-AC inverter 24 to a power supply unit (PSU) 34, while the second contactor 32 connects the 120V single-phase AC power outlet 26 to the PSU 34. Thus, the reversing contactor prevents "back feeding" of electrical power to either the DC-to-AC inverter 24 or to the 120V single-phase AC power outlet (electrical power grid) 26. The first and second contactors 30 and 32 are interconnected by a low voltage control relay 28, in turn connected to the battery unit 22. The reversing contactor thus prevents supplying the 120V single-phase AC grid power to the DC-to-AC inverter 24 and thereafter to the battery unit 22.

The low voltage control relay 28 controls operation of the first and second contactors 30 and 32 based on the battery charge (i.e., an output voltage) of the battery unit 22. Specifically, if the battery charge gets too low for operation of the waste compactor 2 (lower than a threshold value of the battery charge, preferably 12VDC), the low voltage control relay 28 will open the first contactor 30 and close the second contactor 32, thus disconnecting the battery unit 22 and switching to the single-phase AC power source 26 (i.e., to grid power). The compactor will continue to run on grid power while the solar panel 18 charges the battery unit 22. The low voltage control relay 28 will switch back to the battery unit 22 when there is sufficient battery power to run the waste compactor 2. The required electrical service size for the unit is a 30 A breaker. In operation, the battery unit 22 is charged solely by the solar panel 18 through the solar panel controller 20, and a battery charge is maintained solely by the solar panel 18 and the solar panel controller 20. The waste compactor 2 operates on either the 12 volt battery power from the battery unit 22 or the 120 volt single-phase grid power, while the battery unit 22 of the waste compactor 2 of the present invention is not charged by the AC grid power but only by the solar panel 18.

The electrical circuit 14 further includes a programmable logic controller (PLC) 36 that controls overall operation of the hydraulic power unit 10. The PLC 36 includes a timer 37 for controlling operation of the hydraulic power unit 10. The single-phase 120 volt alternating current (AC) is provided by the power supply unit 34 to a motor/pump assembly 38. In turn, the PLC 36 is connected to the DC-to-AC inverter 24 and the motor/pump assembly 38.

Figure 3:
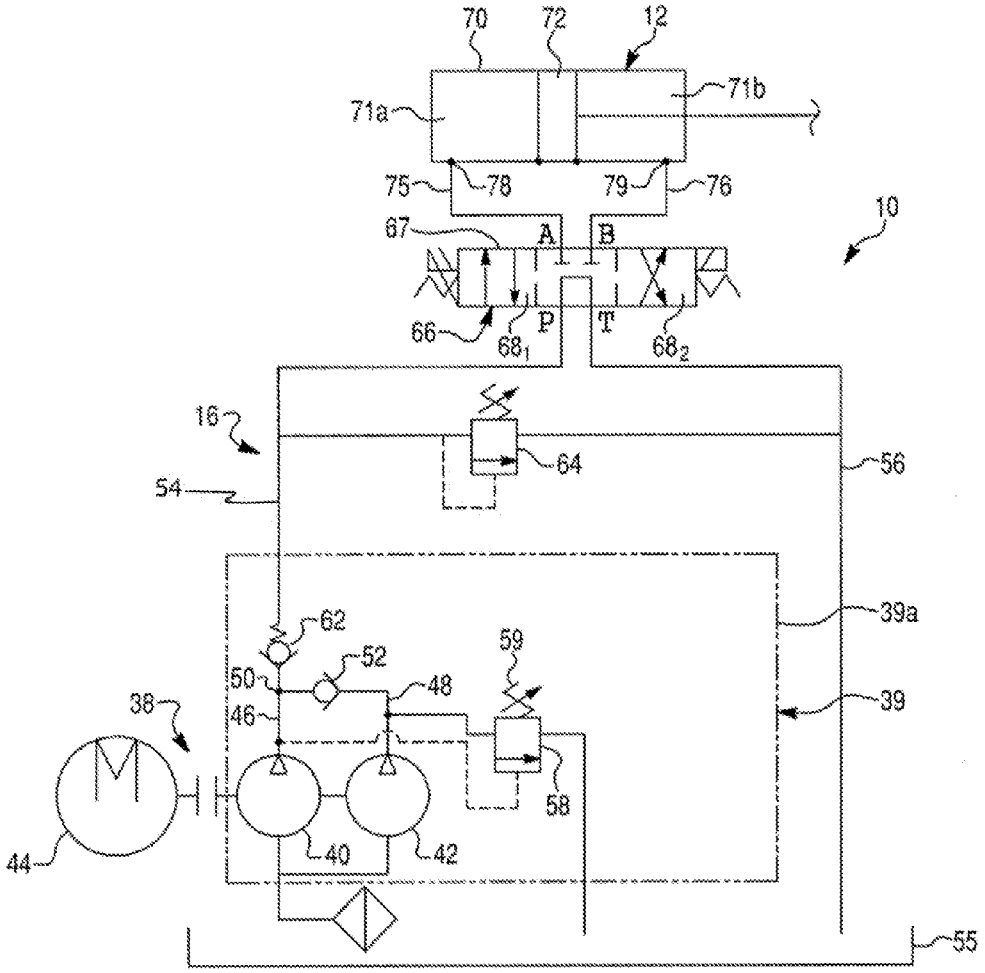
FIG. 3 is a schematic diagram illustrating a hydraulic circuit of the hydraulic power unit of FIG. 1 in accordance with the preferred exemplary embodiment of the present invention.

As best shown in FIG. 3, the motor/pump assembly 38 comprises a pump unit 39 including a first pump section 40 and a second pump section 42 contained in a single housing. A single-phase electric motor 44 is provided to drive the pump unit, i.e., both the first and second pump sections 40, 42, for selectively providing pressurized hydraulic fluid to the hydraulic cylinder and piston assembly 12. The first and second motor driven pump sections 40 and 42 are preferably fixed displacement pumps. The motor/pump assembly 38 further comprises a first output line 46 providing an output from the first pump section 40, a second output line 48 providing an output from the second pump section 42, a node 50 at which flows of the pressurized hydraulic fluid from the first and second output lines 46, 48 are combined, and a first check valve 52 disposed between the second output line 48 and the node 50 for preventing backflow of the pressurized hydraulic fluid to the second pump 42. As illustrated in FIG. 3, the first and second output lines 46 and 48, the node 50 and the first check valve 52 are disposed within a housing 39*a* of the pump unit 39. The combined flow of the pressurized hydraulic fluid from the first and second output lines 46, 48 is conveyed to the hydraulic cylinder and piston assembly 12 through a supply line 54 external to the pump unit 39, and is returned back to a fluid reservoir 55, containing a supply of the hydraulic fluid, through a return line 56. The single-phase electric motor 44 is supplied with the single-phase 120 VAC by the power supply unit 34. The PLC 36 selectively controls the single-phase electric motor 44 based on a predetermined operation time defined by the PLC timer 37 and/or an operating pressure of the motor/pump assembly 38 as detected by a pressure switch (sensor) 60 mounted to the supply line 54 at the pump unit 39 (as illustrated in FIG. 2).

The motor/pump assembly 38 of the hydraulic power unit 10 selectively operates in a first (or high) flow mode and a second (or low) flow mode of operation of the pump unit 39 based on the operating pressure of the motor/pump assembly 38 as detected by the pressure switch 60. Specifically, in the first flow mode of operation, when the operating pressure of the pump unit 39 is less than a predetermined threshold value (for example, 550 psi), the pump unit 39 delivers the pressurized hydraulic fluid to the hydraulic cylinder and piston assembly 12 through the supply line 54 at a first (high) flow rate of the hydraulic fluid, while in the second flow mode of operation, when the operating pressure of the pump unit 39 is more than the predetermined threshold value, the pump unit 39 delivers the pressurized hydraulic fluid at a second (low) flow rate of the hydraulic fluid. The first flow rate of the pressurized hydraulic fluid is larger than the second flow rate thereof. The pressure of the hydraulic fluid flow generated by the motor/pump assembly 38 in the first (high) flow mode is lower than in the second (low) flow mode of operation. It should be understood that when the second pump 42 is generating the pressurized hydraulic fluid and the first check valve 52 is open, the operating pressure of the hydraulic fluid in the second output line 48 is the same as the operating pressure in the supply line 54. In order to provide the first and second flow modes of operation, the pump unit 39 further includes a flow control valve 58, preferably in the form of a pressure relief valve biased to a closed position by bias spring 59 (i.e., a normally closed pressure relief valve). As shown in detail in FIG. 3, the flow control valve 58 is disposed between the second pump 42 and the fluid reservoir 55. In the first flow mode of operation, when the operating pressure in the supply line 54 is less than the predetermined threshold value, the flow control valve 58 is closed due to the biasing force of the bias spring 59. Accordingly, the pressurized hydraulic fluid generated by both the first pump 40 and second pump 42 is delivered to the supply line 54, thus providing the first (high) flow rate as both pumps 40, 42 supply the pressurized hydraulic fluid to the hydraulic cylinder and piston assembly 12. In the second flow mode of operation, when the operating pressure in the supply line 54 is more than the predetermined threshold value, the pressurized hydraulic fluid generated by the second pump 42 overcomes the spring 59 and switches the flow control valve 58 to the open position, thus unloading the pressurized hydraulic fluid generated by the second pump 42 (i.e., redirecting the pressurized hydraulic fluid generated by the second pump 42 back to the fluid reservoir 55). Accordingly, the pressurized hydraulic fluid generated only by the first pump 40 is delivered to the hydraulic cylinder and piston assembly 12 through the supply line 54, thus providing the second (low) flow rate supplied by the pump unit 39.

Switching between the two operational flow modes allows high pressures typically used by waste compactors to be utilized. For example, about 1850 pounds per square inch (psi) pressure can be achieved by the hydraulic power unit 10 when the motor/pump assembly 38 switches from the first flow mode of operation to the second flow mode of operation (i.e., from operating both the first pump 40 and second pump 42 to operating only the first pump 40).

The battery power from the battery unit 22 or the grid power from the 120V single-phase AC electrical power input 26 is shared by the first and second pumps 40 and 42 such that each of the pumps 40 and 42 provides the hydraulic cylinder and piston assembly 12 of the compactor ram 8 with pressurized hydraulic fluid. In an exemplary embodiment of the present invention, the first pump 40 provides the hydraulic cylinder and piston assembly 12 with about 1.5 gallons per minute (gpm), while the second pump 42 provides about 2.85 gpm for a total of 4.35 gpm of hydraulic fluid. In other words, in the exemplary embodiment of the invention, about 4.35 gpm is output by the motor/pump assembly 38 in the first (high) flow mode of operation (i.e., when both the first and second pumps 40 and 42 supply the pressurized hydraulic fluid to the supply line 54), while about 1.5 gpm is output by the pump unit 39 in the second (low) flow mode of operation of the motor/pump assembly 38 (i.e., when only the first pump 40 supplies the pressurized hydraulic fluid to the supply line 54).

As illustrated in detail in FIG. 3, the hydraulic cylinder and piston assembly 12 includes a hydraulic power cylinder 70 and a power piston 72 provided to reciprocate within the hydraulic power cylinder 70. The power piston 72 within the hydraulic power cylinder 70 defines two fluid chambers on opposite sides of the power piston 72: a first (or base) chamber 71*a* and a second (or rod) chamber 71*b*. The power piston 72 is provided with a power rod 74 extending through the rod chamber 71*b* and drivingly connecting the power piston 72 to the compactor ram 8. It will be appreciated that the reciprocating sliding movement of the power piston 72 within the hydraulic power cylinder 70 is translated into the reciprocating movement of the compactor ram 8 for compacting the waste in the waste container 4.

The power piston 72 (and the power rod 74) of the hydraulic cylinder and piston assembly 12 operates between a retracted position thereof such that the first chamber 71*a* has a minimum volume, while the second chamber 71*b* has a maximum volume; and an extended position such that the second chamber 71*b* has a minimum volume, while the first chamber 71*a* has a maximum volume. In the retracted position, the power rod 74 extends from the power cylinder 70 a minimum length, while in the extended position, the power rod 74 extends from the power cylinder 70 a maximum length. Accordingly, the compactor ram 8 achieves an extended phase when the power piston 72 (and the power rod 74) has moved from the retracted position to the extended position, and a retraction phase when the power piston 72 has moved from the extended position to the retracted position, which collectively constitute compactor operating (or duty) cycle of the hydraulic power unit 10 of the waste compactor 2.

As further illustrated in FIGS. 2 and 3, the hydraulic power unit 10 further comprises a directional control valve 66 that controls the direction of hydraulic fluid between the pump unit 39, the hydraulic cylinder and piston assembly 12 and the fluid reservoir 55, thereby controlling extension and/or retraction of the power rod 74 of the piston and cylinder assembly 12. The directional control valve 66 is coupled to the supply line 54 and the return line 56 for controlling an output direction of the combined flow of the pressurized hydraulic fluid from the node 50 to control fluid flow to the hydraulic cylinder and piston assembly 12 for extending and retracting the compactor ram 8.

The directional control valve 66 includes a supply port P, a discharge port T, a first work port A, a second work port B, and a movable control member 67 that functions to connect the work ports A, B selectively to corresponding ones of the supply port P and the discharge port T and to thus control the direction of flow of fluid through the directional control valve 66. Preferably, the directional control valve 66 is a solenoid operated valve such that the movement of the control member 67 is automatically controlled by the PLC 36. The PLC 36 selectively shifts the movable control member 67 of the directional control valve 66 between any of the two positions: an extending position $\mathbf{68}_1$ and a retracting position $\mathbf{68}_2$.

As best shown in FIG. 3, the supply line 54 extends from the pump unit 39 to the supply port P of the directional control valve 66, while the return line 56 extends from the discharge port T of the directional control valve 66 to the fluid reservoir 55. In turn, the directional control valve 66 is fluidly connected to the first chamber 71 a of the hydraulic power cylinder 70 through a first conduit 75 and to the rod chamber 71*b* thereof through a second conduit 76. As shown in detail in FIG. 3, the first conduit 75 fluidly interconnects the first work port A of the directional control valve 66 with inlet port 78 of the first chamber 71*a*, while the second conduit 76 fluidly interconnects the second work port B of the directional control valve 66 with inlet port 79 of the second chamber 71*b*. The directional control valve 66 controls the direction of hydraulic fluid to and/or from the first and second chambers 71*a* and 71*b* of the hydraulic power cylinder 70 in order extend or retract the power rod 74 (thus, of the compactor ram 8) of the piston and cylinder assembly 12.

The pump unit 39 further includes a second check valve 62 disposed on the supply line 54 between the directional control valve 66 and the nod 50, and a normally closed pressure relief valve 64. The second check valve 62 prevents the hydraulic fluid from flowing toward the pump unit 39. The pressure relief valve 64 opens when the operating pressure in the supply line 54 is more than a maximum threshold value (for example, 1950 psi) to unload the pressurized hydraulic fluid generated by the pump unit 39 back into the fluid reservoir 55.

The directional control valve 66 of the hydraulic power unit 10 selectively operates the hydraulic cylinder and piston assembly 12 in and of an extending mode of operation and a retracting mode of operation that constitute an operational cycle thereof.

In the extending mode of operation, the PLC 36 actuates a control solenoid of the directional control valve 66 so as to switch the control member 67 of the directional control valve 66 to the extending position $\mathbf{68}_1$ thereof (left side portion of the directional control valve 66 as shown in FIG. 3) wherein the pressurized hydraulic fluid generated by the pump unit 39 is directed by the directional control valve 66 to the first chamber 71*a*, while discharging the hydraulic fluid from the second chamber 71*b* back to the fluid reservoir 55. In the extending position $\mathbf{68}_1$ of the control member 67 of the directional control valve 66, the supply port P is fluidly connected to the first work port A thereof, while at the same time the discharge port T is fluidly connected to the second work port B. It will be appreciated that in the extending mode of operation, the pressurized hydraulic fluid generated by the pump unit 39 will move the power piston 72 and the power rod 74 of the hydraulic cylinder and piston assembly 12 toward the extended position thereof, thus pushing the compactor ram 8 into the waste container 4 for transferring the waste from the charge box 6 into the waste in the waste container 4. Continued cycling of the ram 8 will cause the container 4 to fill with waste with the result that further cycling of the ram 8 will cause the waste in the container 4 to become compacted.

In the retracting mode of operation, the PLC 36 actuates the control solenoid of the directional control valve 66 so as to switch the control member 67 of the directional control valve 66 to the retracting position $\mathbf{68}_2$ thereof (right side portion of the directional control valve 66 as shown in FIG. 3) wherein the pressurized hydraulic fluid generated by the pump unit 39 is directed by the directional control valve 66 to the second chamber 71*b*, while discharging the hydraulic fluid from the first chamber 71*a* back to the fluid reservoir 55. It will be appreciated that in the retracting mode of operation, the pressurized hydraulic fluid generated by the pump unit 39 will move the power piston 72 and the power rod 74 of the hydraulic cylinder and piston assembly 12 toward the retracted position thereof, thus pulling the compactor ram 8 away from the waste in the waste container 4.

The operation of the waste compactor 2 according to the present invention is as follows.

The operating cycle of the hydraulic power unit 10 of the waste compactor 2 is started by pressing in on a keyswitch (or start button) electrically connected to the PLC 36. At this point the hydraulic cylinder and piston assembly 12 is in the retracted position. When the start button is depressed the PLC 36 sends a run signal to the motor/pump assembly 38 to provide power to the single-phase electric motor 44 thereof (i.e., to start the electric motor 44), and the timer 37 of the PLC 36 starts counting the predetermined operation time. In turn, the single-phase electric motor 44 starts driving the first and second pumps 40, 42 that generate the pressurized hydraulic fluid flow. As the operating pressure of the motor/pump assembly 38 as detected by the pressure switch 60 is initially lower than the predetermined threshold value at the beginning of the operating cycle of the hydraulic power unit 10 of the waste compactor 2, the flow control valve 58 is in the closed position and the control member 67 of the directional control valve 66 is switched by the PLC 36 to the extending position $\mathbf{68}_1$ thereof and the motor/pump assembly 38 is in the first (high) flow mode of operation so as to move the power rod 74 (and the compactor ram 8) of the hydraulic cylinder and piston assembly 12 to the extended position thereof.

As the waste container 4 begins to fill, the operating pressure of the hydraulic cylinder and piston assembly 12 increases. When the operating pressure of the motor/pump assembly 38 reaches the predetermined threshold pressure (for example, of 550 psi), the flow control valve 58 moves to the open position, thus switching the motor/pump assembly 38 to the second (low) flow mode of operation generating higher pressure of the hydraulic fluid so as to continue to increase the operating pressure until a maximum pressure is reached. This enables the hydraulic power unit 10 to provide the full (maximum) pressure required for the waste compactor 2, typically 1850 psi, although this may vary by model.

Then, when the timer 37 in the PLC 36 times out (i.e., when the operation time of the hydraulic power unit 10 reaches the predetermined operation time), the control member 67 of the directional control valve 66 is shifted to the retracting position $68_2$ by the PLC 36 to operate the motor/pump assembly 38 in the retracting mode. Typically, at this time, the power rod 74 (and the compactor ram 8) of the hydraulic cylinder and piston assembly 12 has reached the extended position. In the retracting mode of operation, the power rod 74 (and the compactor ram 8) of the hydraulic cylinder and piston assembly 12 move back to the retracted position thereof, thus finishing the operating cycle of the hydraulic power unit 10 of the waste compactor 2 and allowing waste to be deposited into charge box 6. However, even if the timer 37 in the PLC 36 does not time out (i.e., the hydraulic power unit 10 operates less than the predetermined operation time), the hydraulic power unit 10 shuts down when the waste container 4 is full. Preferably, the waste container 4 is detected to be fall when the operating pressure of the motor/pump assembly 38 as detected by a pressure switch (sensor) 60 reaches a predetermined maximum value, for example, 1850 psi.

The hydraulic power unit 10 of the present invention is further provided to selectively operate in a "sleep" mode which turns off the inverter 24 and conserves the power of the battery unit 22 when the hydraulic power unit 10 is not in use. An illuminated "Power On" pushbutton is used to indicate whether or not the unit is asleep. If the light is illuminated, then the hydraulic power unit 10 is awake and ready to cycle. When operating on battery power, the hydraulic power unit 10 will go into the "sleep" mode after a set period of inactivity. To wake the hydraulic power unit 10 (i.e., to bring the hydraulic power unit 10 out from the "sleep" mode) the operator will depress and release the "Power On" pushbutton. The light in the pushbutton will illuminate indicating the hydraulic power unit 10 is ready to cycle. When the hydraulic power unit 10 is operating on grid power from the 120V single-phase AC electrical power input 26, the "Power On" light of the pushbutton will be constantly illuminated.

The battery charge is maintained by the solar panel 18 and the solar panel controller 20. If the battery charge gets too low for operation of the waste compactor 2 (lower than the threshold value of the battery charge, i.e., 12VDC), the low voltage control relay 28 will switch the hydraulic power unit 10 to the single-phase AC grid power. The waste compactor 2 will continue to run on the grid power while the solar panel 18 charges the battery unit 22. The low voltage control relay 28 will switch back to the battery unit 22 when there is sufficient battery power to run the waste compactor 2.

Therefore, the waste compactor 2 of the present invention provides a number of advantages over the conventional waste compactors, including energy savings due to sustainable power and the ability to install the waste compactor of the present invention without any grid power, by the use of multiple battery banks. Moreover, the waste compactor of the present invention provides continuous operating cycle, better efficiency, and more versatility. Standard compactor options could be available on the waste compactor of the present invention, including a multi-cycle timer. Another advantage of the waste compactors of the present invention over the prior art is that the battery unit 22 of the waste compactor 2 of the present invention is not charged by the AC grid power but only by the solar panel 18, thus there is no parasitic grid power usage while not operating on the grid power.

The foregoing description of the preferred exemplary embodiment of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A method of powering a compactor ram of a waste compactor, comprising the steps of:

providing a hydraulic power unit operably associated with a hydraulic cylinder and piston assembly for powering said compactor ram of said waste compactor, said hydraulic, power unit comprising motor/pump assembly comprising a pump unit including first and second pumps for providing pressurized hydraulic fluid to said hydraulic cylinder and piston assembly associated with said compactor ram, a single-phase electric motor for driving said pump unit, a flow control valve for selectively providing the pressurized hydraulic fluid to said hydraulic cylinder and piston assembly, and a battery unit for storing electrical energy and for providing the electrical energy to said single-phase electric motor;

a directional control valve in fluid communication with both said motor/pump assembly and said hydraulic cylinder and piston assembly for selectively controlling flow of the pressurized hydraulic fluid to/from said hydraulic cylinder and piston assembly for extending and retracting said compactor ram;

a solar panel for converting solar energy to the electrical energy, said solar panel adapted to charge said battery unit;

a DC-to-AC inverter configured to convert a direct current from said battery unit into a single-phase alternating current;

a single-phase AC power inlet connectable to a source of a single-phase electrical power grid; and a reversing contactor including a first contactor provided between said DC-to-AC inverter and said single-phase electric, motor and a second contactor provided between said single-phase AC power inlet and said single-phase electric motor, said reversing contactor preventing said first and second contactors from closing connections thereof at the same time so as to provide electric current only from one of said DC-to-AC inverter and said single-phase AC power inlet at any given time and to prevent backflow of the electrical current to either said DC-to-AC inverter or to the electrical power grid;

providing said hydraulic cylinder and piston assembly with the pressurized hydraulic fluid generated by both said first and second pumps when an operating pressure of said motor/pump assembly is less than a predetermined threshold;

providing said hydraulic cylinder and piston assembly with the pressurized hydraulic fluid generated by only said first pump when the operating pressure of said motor/pump assembly is greater than the predetermined threshold; and controlling said directional control valve to selectively operate said hydraulic cylinder and piston assembly in extending and retracting modes of operation.

2. The method as defined in claim 1, wherein when said waste compactor is initially turned on, said motor/pump assembly provides said hydraulic cylinder and piston assembly with the pressurized hydraulic fluid provided by both said first and second pumps when an operating pressure of said motor/pump assembly is less than the predetermined threshold and said directional control valve is in an extending position so as to operate said hydraulic cylinder and piston assembly in said extending mode of operation to extend said compactor ram and to increase the operating pressure until a predetermined operation time of said hydraulic, power unit is reached, at which point said motor/pump assembly is operated in said retracting mode of operation to retract said compactor ram.

3. The method as defined in claim 2, wherein when said predetermined threshold value is reached, said motor/pump assembly provides said hydraulic cylinder and piston assembly with the pressurized hydraulic fluid provided only by said first pump and said directional control valve is in an extending position so as to operate said hydraulic cylinder and piston assembly in said extending mode of operation to continue to increase the operating pressure until said waste container is full, at which point said hydraulic power unit shuts down.

4. A method of powering a compactor ram of a waste compactor, comprising the steps of:

providing a waste container for housing waste;

providing a compactor ram actuated by a hydraulic cylinder and piston assembly for compacting the waste in said waste container; and providing a hydraulic power unit operably associated with said hydraulic cylinder and piston assembly for powering said compactor ram, said hydraulic power unit comprising:

a motor/pump assembly including a pump unit, a single-phase electric motor driving said pump unit for selectively providing hydraulic fluid to said hydraulic cylinder and piston assembly and a flow control valve operating said motor/pump assembly at a first flow rate of the hydraulic fluid when an operating pressure of said pump unit is less than a predetermined threshold value and operating said motor/pump assembly at a second flow rate of the hydraulic fluid when the operating pressure of said pump unit is greater than the predetermined threshold value;

a battery unit for storing electrical energy and for providing the electrical energy to said single-phase electric motor;

a solar panel for converting solar energy to electrical energy to charge said battery unit;

providing a DC-to-AC inverter converting a direct current from said battery unit into a single-phase alternating current;

providing a single-phase AC power inlet connectable to a source of a single-phase electrical power grid; and providing a reversing contactor including first contactor provided between said DC-to-AC inverter and said single-phase electric motor and a second contactor provided between said single-phase AC power inlet and said single-phase electric motor, said reversing contactor preventing said first and second contactors from closing connections thereof at the same time so as to provide the electric current only from one of said Dc-to-AC inverter and said single-phase AC power inlet at any given time and to prevent backflow of electrical current to either said DC-to-AC inverter or to the electrical power grid.

5. The method as defined in claim 4, further comprising the step of providing a first pump section and a second pump section both driven by said single-phase electric motor.

6. The method as defined in claim 5, further comprising the step of providing a first output line defining an output from said first pump section, and a second output line defining an output from said second pump section.

7. The method as defined in claim 6, further comprising the step of providing a node at which flows of the hydraulic fluid from said first and second output lines are combined and providing a check valve disposed between said second output line and said node for preventing backflow of the hydraulic fluid to said second pump section.

8. The method as defined in claim 7, further comprising the step of providing a reservoir containing a supply of the hydraulic fluid, a supply line provided for conveying the hydraulic fluid combined from said first and second output lines to said hydraulic cylinder and piston assembly and providing a return line delivering the hydraulic fluid from said hydraulic cylinder and piston assembly back to said fluid reservoir.

9. The method as defined in claim 8, further comprising the step of operating said motor/pump assembly as a second flow rate when said hydraulic power unit is initially turned on, and said directional control valve switches to an extending position so as to operate said hydraulic cylinder and piston assembly in said extending mode of operation to extend said compactor ram until a predetermined operation time of said hydraulic power unit is reached.

10. The method as defined in claim 9, further comprising the step of providing a logic controller including a timer provided for timing an operation of said hydraulic power unit and detecting said predetermined operation time, and providing a pressure sensor for detecting the operating pressure at said pump unit.

11. The method as defined in claim 10, further comprising, the step of automatically controlling said directional control valve by said logic controller based on the operation time detected by said timer.

12. The method as defined in claim 10, further comprising the step of controlling said first and second contactors with a voltage relay based on battery charge of said battery unit.

13. The method as defined in claim 9, further comprising the step of switching said directional control valve to a retracting position when said predetermined operation time is reached, so as to operate said hydraulic cylinder and piston assembly in said retracting mode of operation to retract said compactor ram.

* * * * *